US010837189B2

(12) United States Patent
Vogtner

(10) Patent No.: US 10,837,189 B2
(45) Date of Patent: Nov. 17, 2020

(54) WATER-HOLDING STRUCTURE BONDING KIT

(71) Applicant: Custom Molded Products, LLC, Newman, GA (US)

(72) Inventor: Zachary T. Vogtner, Atlanta, GA (US)

(73) Assignee: Custom Molded Products, LLC, Newnan, GA (US)

( * ) Notice: Subject to any disclaimer, the term of this patent is extended or adjusted under 35 U.S.C. 154(b) by 0 days.

(21) Appl. No.: 15/294,834

(22) Filed: Oct. 17, 2016

(65) Prior Publication Data

US 2017/0030099 A1 Feb. 2, 2017

Related U.S. Application Data

(63) Continuation-in-part of application No. 14/527,910, filed on Oct. 30, 2014, now abandoned, and a continuation-in-part of application No. 15/050,816, filed on Feb. 23, 2016, now abandoned, which is a continuation-in-part of application No. 14/527,910, filed on Oct. 30, 2014, now abandoned.

(51) Int. Cl.
*E04H 4/12* (2006.01)

(52) U.S. Cl.
CPC ..... *E04H 4/1272* (2013.01)

(58) Field of Classification Search
CPC ..... E04H 4/12; E04H 4/1272; E04H 4/06; H01R 13/65802; H01R 13/648; H01R 13/652; H01R 4/64; H01R 4/643; H01R 4/646
USPC ..... 4/507–509; 439/92–108
See application file for complete search history.

(56) References Cited

U.S. PATENT DOCUMENTS

| | | | | |
|---|---|---|---|---|
| 4,623,204 | A * | 11/1986 | Auclair | H01R 4/40 439/100 |
| 4,660,908 | A * | 4/1987 | Ballester | H01R 4/64 29/854 |
| 5,914,547 | A | 6/1999 | Barahia | |
| 6,966,079 | B2 * | 11/2005 | Stetson | E04H 4/1272 4/506 |
| 9,194,148 | B1 | 11/2015 | Koller | |
| 9,431,725 | B2 * | 8/2016 | Saccoccio | H01R 4/66 |
| 9,761,990 | B2 * | 9/2017 | Koller | H01R 13/5219 |
| 9,837,733 | B2 * | 12/2017 | Saccoccio | H01R 4/66 |
| 2015/0167335 | A1 * | 6/2015 | Saccoccio | H01R 4/66 439/97 |

FOREIGN PATENT DOCUMENTS

GB 2154079 A 8/1985

* cited by examiner

*Primary Examiner* — Erin Deery
(74) *Attorney, Agent, or Firm* — Laurence P. Colton; Smith Tempel Blaha LLC

(57) ABSTRACT

A bonding kit for use with a water-holding structure, the kit having a bonding conductor with a body portion configured to reside within a component attached to the water-holding structure. The bonding conductor includes an extension portion configured to extend outwardly from the component. The bonding kit includes a conductor fitting configured to attach to the extension portion of the bonding conductor and to attach to a conductive system of the water-holding structure, providing an electrical connection between the bonding conductor, or water therein, and the conductive system, the bonding conductor providing equipotential bonding for water contained in the water-holding structure.

10 Claims, 11 Drawing Sheets

WATER-HOLDING STRUCTURE BONDING KIT

STATEMENT OF RELATED APPLICATIONS

This application is a continuation-in-part of U.S. patent application Ser. No. 14/527,910 having a filing date of 30 Oct. 2014, and also is a continuation-in-part of U.S. patent application Ser. No. 15/050,816 having a filing date of 23 Feb. 2016, which is a continuation-in-part of U.S. patent application Ser. No. 14/527,910 having a filing date of 30 Oct. 2014.

BACKGROUND OF THE INVENTION

Technical Field

This invention relates to kits for use in bonding water structures, such as pools and spas, to bonding pool pumps, and more particularly to kits and retrofit kits for use in bonding water-holding structures such as swimming pools, spas, or hot tubs. This invention further relates to kits for bonding water structures that can be fitted or retrofitted to pool features, such as a skimmer with a water bond feature and a hose adapter with a water bond feature, which can be used in the water-holding structures, such as above-ground and in-ground pools.

Prior Art

Some installation codes, including the National Electric Code (NEC), require that water-holding structures, such as a pool, be equipotentially bonded. Equipotential bonding (or "bonding") for such structures requires permanent joining of metallic parts of the structure to form an electrically conductive path that ensures electrical continuity and the ability to safely conduct any current likely to be imposed. Such bonding establishes equal electrical potential (voltage) in the water-holding structure or pool and ensures that no voltage gradients are present between various areas in or around the pool. By ensuring that the various areas of a pool are at the same electrical potential, the danger of possible electrical shock hazards from stray currents generated by nearby power sources traveling to the pool through the ground or through piping connected to the pool is minimized.

Historically, the pool water was typically bonded to the equipotential grid by running a bonding wire to the metal niche in which a large (8"-12") light is installed. The metal niches were installed in contact with the water providing the necessary minimum surface area contact (9 square inches) required for the bond. Recently, smaller LED lights have become popular, and many of these do not install with a niche as they can install into a standard plastic wall return fitting. Many pools are built now without any of the larger niche lights, so there is a need for a new way to provide the nine square inches of conductive surface area in constant contact with the pool water. Likewise, as older pools are remodeled to replace older lighting with newer "niche-less" style LED lights, there is a need to invent a retrofit means of providing the nine square inches of conductive surface area in constant contact with the pool water.

Thus, while newer installations of pools or structures are bonded, many older already-existing pools were not. Trying to bond these already-existing pools (or pool components such as pumps, pump traps, skimmers and the like) to meet the codes can be difficult and expensive. Most solutions require replacing a pre-code component, e.g., a pump or pump trap that does not allow for bonding with an entirely new component, e.g., a pump or pump trap that allows for bonding.

Accordingly, it would be desirable to provide a way to retrofit currently installed water-holding structure components, such as pumps, pump traps, skimmers, and the like, to allow for equipotential bonding of the water therein. It also would be desirable to provide kits that can be fitted or retrofitted onto current components for water features for installation on or currently installed on water-holding structures to allow for equipotential bonding of the water therein. It is to this need and others that the present invention is directed.

BRIEF SUMMARY OF THE INVENTION the present invention generally is a kit for use with water-holding structures such as pools in order to provide equipotential bonding to components of the water-holding structure or to the water therein. An exemplary kit comprises a bonding conductor with a body portion configured to reside within a component attached to the pool, and in constant contact with the pool water. The bonding conductor also includes an extension portion configured to extend outwardly from an outer surface of the component attached to the pool. The exemplary kit further includes a strain relief fitting configured to receive the extension portion of the bonding conductor, and to couple with the component attached to the pool, thus holding the bonding conductor in place after installation. The kit also includes a conductor fitting configured to attach to the extension portion of the bonding conductor and to attach to a conductive system of the pool, providing an electrical connection between the bonding conductor and the conductive system for the pool. The bonding conductor thus provides equipotential bonding for the pool water in contact with said component.

An exemplary embodiment of the invention is in the form of a retrofit kit, such as a water trap located between the pool body and the water pump. Water traps are known in the art and often comprise an enlarged portion housing a filter basket so as to trap any leaves or other debris circulating form the pool body through the water lines towards the water pump. The retrofit kit can be fitted within or proximal to the water trap.

Another exemplary embodiment of the invention is in the form of a new part, a replacement part, or a retrofit kit, such as an adapter fitting for connecting hoses together or to other parts in the water circulation system of a water feature. Adapter fittings are known in the art and often comprise a screw thread and nut or a friction connector and nut. The kit can be fitted within the adapter fitting.

Another exemplary embodiment of the invention is in the form of a new part or a replacement part, such as a skimmer housing for holding a skimmer typically at the side of a water feature. Skimmers and skimmer housings are known in the art and often comprise a housing secured within the wall structure or at the edge of a pool, and a skimmer removably fitted within the housing for catching debris from the pool and preventing the debris from entering the water circulation system of the pool. The kit can be fitted within the skimmer housing.

A complete understanding of the present invention may be obtained by reference to the accompanying drawings, when considered in conjunction with the detailed description of preferred embodiments, in which like elements and components bear the same designations and numbering throughout the figures.

BRIEF DESCRIPTION OF THE DRAWINGS

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Aspects, features and advantages of several exemplary embodiments of the present invention will become better understood with regard to the following description in connection with the accompanying drawings. It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Any aspect described herein as exemplary is not necessarily to be construed as exclusive, preferred or advantageous over other aspects.

Figure 1:
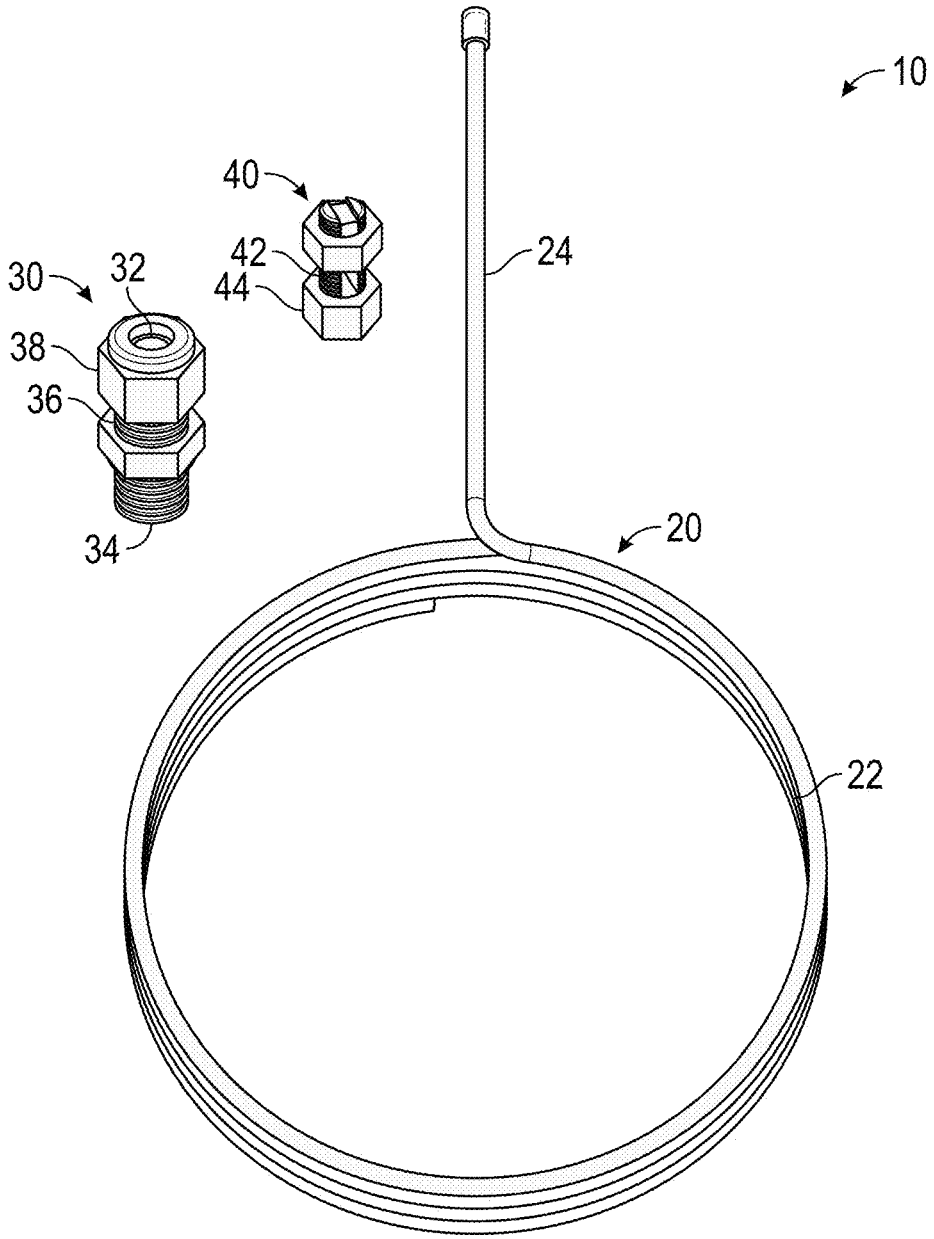
FIG. 1 is a perspective view of an exemplary bonding kit for use with a water-holding structure.
Figure 2:
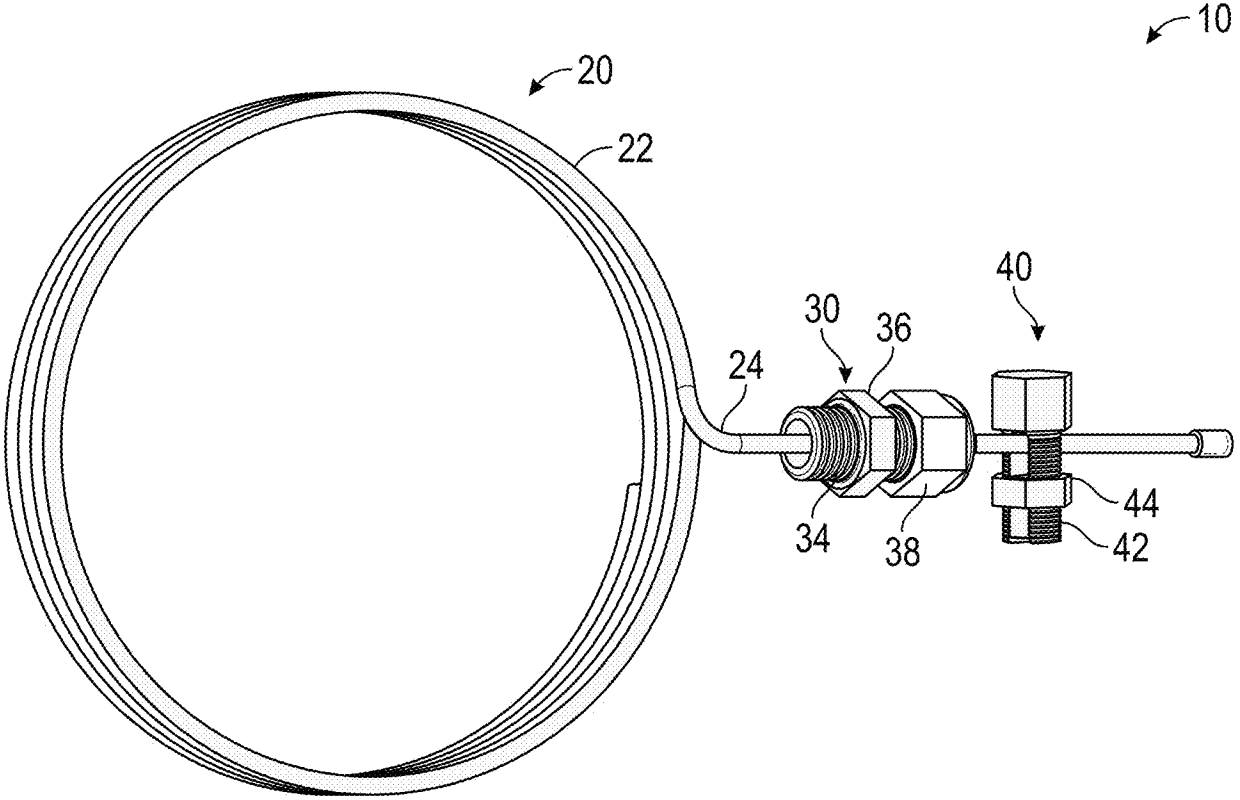
FIG. 2 is a top view of the exemplary bonding kit illustrated in FIG. 1, showing an exemplary engagement of the parts of the retrofit kit.

FIGS. 1 and 2 show an exemplary bonding kit 10 for use with structures for which equipotential bonding is desired is illustrated. FIG. 1 is a perspective view of an exemplary bonding kit for use with pools. FIG. 2 is a top view of the exemplary bonding kit illustrated in FIG. 1, showing an exemplary engagement of the parts of the bonding kit. One such structure for which equipotential bonding is desirable, and in some instances required, is a swimming pool (not shown), and the discussion of the bonding kit 10 illustrated in FIGS. 1 and 2 will be in terms of use with an pool in order to ease understanding. However, as will be appreciated by one of ordinary skill in the art, the bonding kit 10 may be used with any desired structure to provide equipotential bonding, for example, to a water-holding structure such as a spa, an aboveground pool, an inground pool, a whirlpool bath, a Jacuzzi® whirlpool bath, a hydromassage unit, a hot tub, fountains, and the like The exemplary bonding kit 10 illustrated in FIGS. 1 and 2 includes a bonding conductor 20, a strain relief fitting 30, and a split bolt connector 40.

The illustrated bonding conductor 20 comprises a body portion 22 and an extension portion 24 extending from the body portion 22. In the illustrated embodiment, the bonding conductor 20 is formed from a single wire where the body portion 22 comprises a generally circular coil of the wire and the extension portion 24 comprises a straight portion of the wire extending at approximately a right angle from the body portion 22 and being generally coplanar with the body portion 22. Although illustrated as a circular coil, the body portion 22 of the bonding conductor 20 may be any shape desired. Similarly, although illustrated as a generally straight portion extending at a right angle in a coplanar manner from the body portion 22, the extension portion 24 may be configured in any manner desired. One of ordinary skill in the art would understand that such shape and/or manufacture of the bonding conductor 20 could vary depending on the specific component or structure for which the bonding kit 10 is intended.

Figure 3:
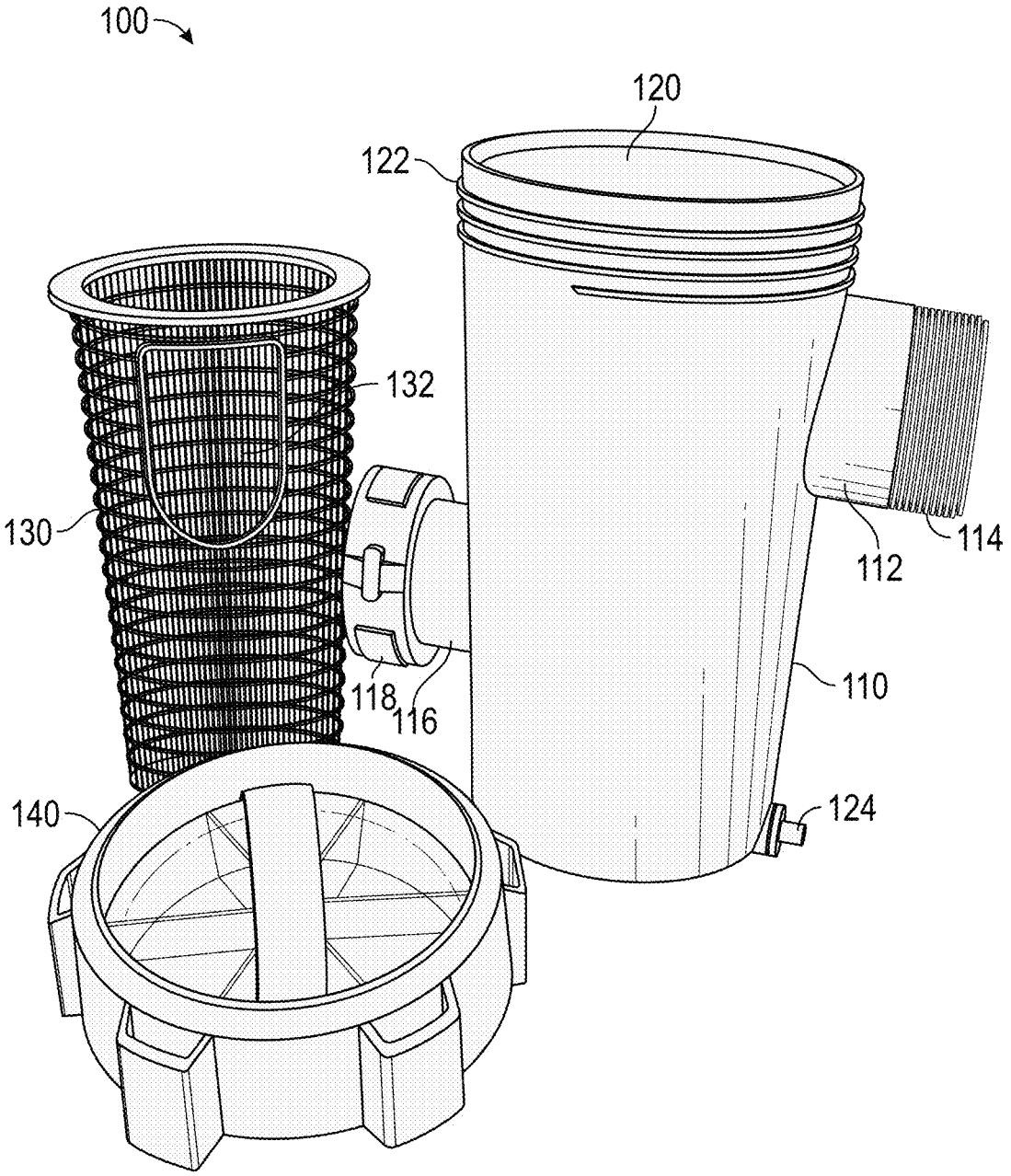
FIG. 3 is a side view of exemplary components of an illustrative pump trap for a water-holding structure with which the bonding kit of FIG. 1 may be used.

As disclosed herein, the illustrated bonding kit 10 is dimensioned for use with a swimming pool pump trap that is generally cylindrical in shape (see FIG. 3). For retrofit kits 10 intended for other swimming pool components, or pump traps of differing shape, or other water-holding structures, the body portion 22 and/or extension portion 24 may be shaped or configured differently. Regardless of shape or configuration, it is preferred that the body portion 22 of the bonding conductor 20 comprises at least nine square inches of conductive surface to meet the bonding requirements of the National Electrical Code (NEC).

The exemplary bonding kit 10 illustrated in FIGS. 1 and 2 also includes a strain relief fitting 30 configured to be coupled with the extension portion 24 of the bonding conductor 20 when installed. The illustrated strain relief fitting 30 is hollow (as illustrated with the top opening 32 that extends all the way through the fitting 30) is and generally cylindrical. The preferred strain relief fitting 30 has an inner diameter and an outer diameter. The outer diameter of the strain relief fitting 30 is dimensioned so as to allow installation of the bonding conductor 20 in the pool component to be bonded. The inner diameter of the strain relief fitting 30 is dimensioned so as to fit around the bonding conductor 20, and to assist in preventing movement of the bonding conductor 20 once installed.

To assist in keeping the bonding conductor 20 in place when installed, the strain relief fitting 30 may include a threaded portion 34 to engage the pool component to hold the bonding conductor 20 in place. The strain relief fitting 30 also may include a connector nut 36 portion configured to allowing tightening of the threaded portion 34 with the pool component to be bonded as disclosed herein. In such embodiments, the connector nut 36 may not be a separate component, but may instead be integrally formed onto the outer surface of the strain relief fitting 30. Alternatively, in other embodiments, the connector nut 36 may be a separate component configured to engage a threaded portion 34 of the outer surface of the strain relief fitting 30. In such embodiments, the connector nut 36 may be used to help hold the installed the bonding conductor 20 in place by tightening the connector nut 36 against the pool component.

To provide further strain relief, the strain relief fitting 30 may also include a hollow cap 38 as illustrated in FIGS. 1 and 2. The hollow cap 38 may be configured to also engage a threaded portion 34 of the outer surface of the strain relief fitting 30. Note that the threaded portion 34 engaged by the cap 38 may be a continuation of the threaded portion 34 discussed above, or a separate threaded portion 34 on the outer surface of the strain relief fitting 30 that is configured to receive the cap 38.

The inner surface of at least the end of the hollow cap 38 is dimensioned so as to fit relatively snugly around the extension portion 24 of the bonding conductor 20. Further, the inner surface of the hollow cap 38 may be comprised of a relatively soft plastic, rubber, elastomer, or other material so as to ensure a snug fit around the extension portion 24 of the bonding conductor 20. When installed on the strain relief fitting 30, such as by engaging the threaded portion 34, the cap 38 may serve to further prevent movement of the installed bonding conductor 20.

Again, the illustrated strain relief fitting 30 is dimensioned and configured to allow use of the bonding kit 10 with a swimming pool pump trap that is generally cylindrical in shape (see FIG. 3). One of ordinary skill in the art would understand that the dimensions, shape, and/or configuration of the strain relief fitting 30 could vary depending on the specific component or structure for which the bonding kit 10 is intended.

In the exemplary embodiment illustrated in FIGS. 1 and 2, the bonding kit 10 also includes a split bolt connector 40 configured to be coupled with the extension portion 24 of the bonding conductor 20 when installed. The preferred split bolt connector 40 is formed from a conductive material and comprises a body portion 42 with a threaded outer surface and a nut portion 44 configured to engage the threaded outer portion of the body portion 42. The split bolt connector 40 may be installed on the extension portion 24 of the bonding conductor 20 once the bonding conductor 20 is installed by inserting the extension portion 24 into the split in the body portion 42 of the split bolt connector 40 and engaging the nut portion 44 with the body portion 42 (see FIG. 2). The split bolt connector 40 then may be coupled to copper or other wire that is coupled at the other end to the swimming pool bonding system. In this manner, the split bolt connector 40 allows the bonding conductor 20 to electrically connect with the bonding system of the swimming pool as needed.

In addition to the different sizes, shapes, configurations, etc., possible for the components of the illustrated bonding kit 10 depending on the pool component with which the bonding kit 10 will be used, one of ordinary skill in the art would also understand that the bonding kit 10 could be comprised of more or fewer components than those shown in FIGS. 1 and 2. For example, not every embodiment of the bonding kit 10 may require a split bolt connector 40 in order to electrically connect the bonding conductor 20 to a bonding system of the pool. Similarly, in some embodiments, additional components may be part of the retro fit kit 10. One such example would be the inclusion of gaskets, O-rings, or the like in order to ensure a watertight installation of the bonding conductor 20 in some implementations. All such variations of the bonding kit 10 are within the scope of this disclosure.

The present invention may be used with any structure for which equipotential bonding is desired. As noted, one exemplary structure may be an already installed pool, in-ground or above-ground. For such a pool, the present invention may allow retrofitted bonding for various components, including a pool pump and/or pool pump trap. FIG. 3 is a side view of exemplary components of an illustrative pump trap 100 for a swimming pool in which the exemplary retrofit kit of FIG. 1 can be installed to provide bonding for the pool water.

The exemplary pump trap 100 includes a housing 110 that is generally cylindrical in shape and hollow with a generally round enclosed bottom and a generally round top opening 120. The exemplary housing 110 includes a pipe connector port 112 extending from the outer surface of the housing 110. The pipe connector port 112 is configured to couple to a pipe carrying water from the pool to a pump coupled to the pump trap 100. The pipe connector port 112 may be a generally cylindrical hollow tube formed into, and extending from, the surface of the housing 110 to allow water from the pool into the housing 110. The pipe connector port 112 may be dimensioned as desired in order to allow installation with pools. The outer surface of the end of the pipe connector port 112 distal from the housing 110 may include a threaded portion 114 in order to facilitate coupling the pipe connector port 112 to a pipe carrying water from the pool.

The illustrated housing 110 also includes a pump connector port 116 extending from the outer surface of the housing 110. As illustrated in FIG. 3 the pump connector port 116 may be located on the opposite outer surface from the pipe connector port 112. However, in other embodiments, the pump connector port 116 may be located elsewhere on the housing 110. The pump connector port 116 is configured to couple to a pump, allowing water carried from the pool to the pump trap 100 to be recirculated into the pool by the pump. The pump connector port 116 may be a generally cylindrical hollow tube formed into, and extending from, the surface of the housing 110 to allow water from the housing 110 to pass to the pump (not shown). The pump connector port 116 may be dimensioned as desired in order to allow installation with any desired pump. The end of the pump connector port 116 distal from the housing 110 may include a connector fitting 118 in order to facilitate coupling the pump connector port 116 to the pump.

The illustrated housing also includes an access or drain hole 124 extending from the outer surface of the housing 110. As illustrated in FIG. 3, the drain hole 124 may be located towards the bottom end of the housing 110, and may be located on the side of the housing 110 opposite of the pump connector port 116. However, in other embodiments, the drain hole 124 may be located elsewhere on the housing 110. The preferred drain hole 124 is a generally round aperture into the housing 110, however other shapes are possible. Additionally, the size of the drain hole 124 may be dimensioned as desired. As illustrated in FIG. 3, the drain hole 124 may be partially sealed with an inserted plug, or the drain hole 124 may be left open. The preferred drain hole 124 illustrated in FIG. 3 has an inner surface that is threaded.

The exemplary pump trap 100 illustrated in FIG. 3 also includes a skimmer or strainer basket 130 that fits inside the housing 110. The strainer basket 130 is generally cylindrical in shape and is hollow with a generally round enclosed bottom and a generally round open top. The strainer basket 130 is dimensioned so as to allow the strainer basket 130 to be inserted into the top opening 120 of the housing 110. The strainer basket 130 also has an inlet opening 132 on one side to receive water from the pool. The inlet opening 132 is dimensioned and configured so as to receive water through the pipe connector port 112 of the housing 110. The surface of the strainer basket 130 contains a plurality of small apertures. In operation, when the strainer basket 130 is inserted into the housing 110, water will flow from the pool through the pipe connector port 112 of the housing 110, and into the strainer basket 130 through the inlet opening 132.

The apertures in the surface of the strainer basket 130 allow the water to then flow freely back out of the strainer basket 130, while any debris (such as bugs, leaves, etc.) in the water will remain inside the strainer basket 130. This represents a skimmer structure.

The exemplary pump trap 100 illustrated in FIG. 3 also includes a lid 140 configured to cover the top opening 120 of the housing 110. The illustrated lid 140 is generally round, and dimensioned to fit over the outer surface of the housing 110 to cover the top opening 120 in order the hold the strainer basket 130 in place within the housing 110. The lid 140 may have a threaded inner surface in order to engage the threaded surface 122 on the housing 110 in order to secure the lid 140 to the housing 110. Other mechanisms for securing the lid 140 to the housing 110 may be used instead of, or in addition to, the illustrated threads. The lid 140 may also include a transparent portion in the top of the lid 140 to allow a user to see whether debris has accumulated in the strainer basket 130 within the housing 110.

Figure 4:
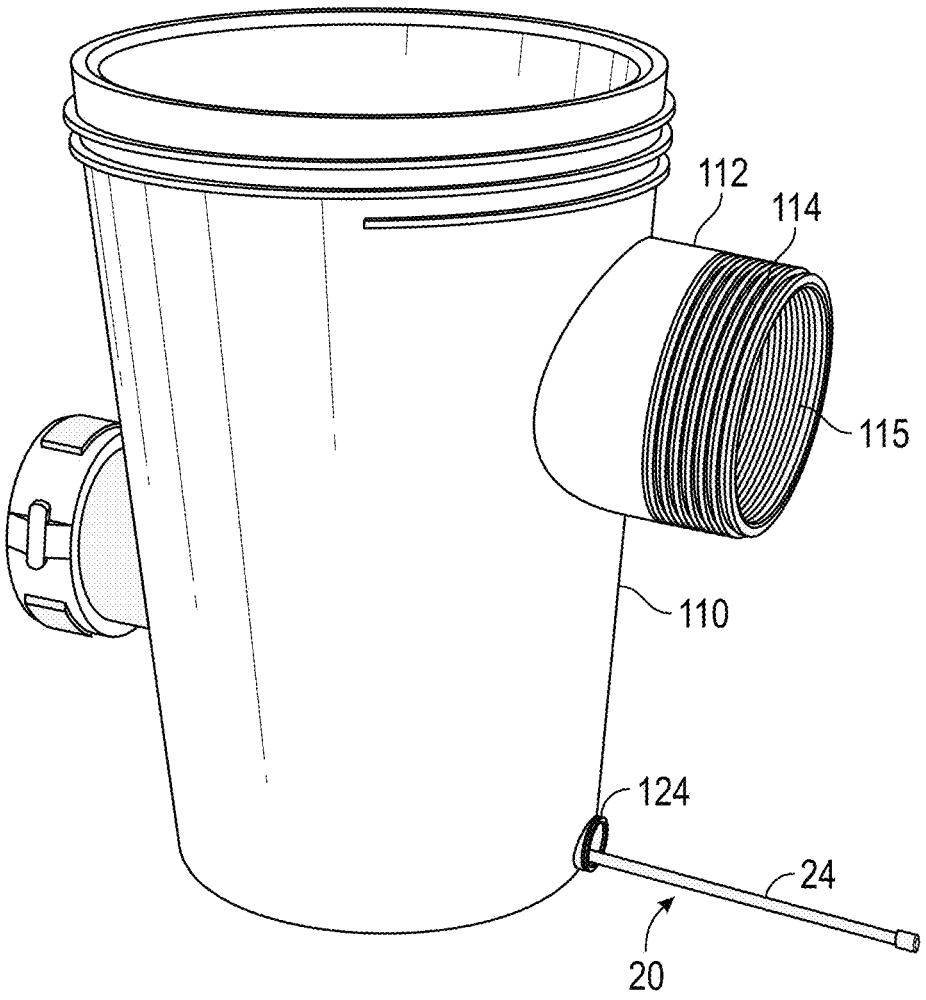
FIG. 4 is a perspective view of the illustrative pump trap of FIG. 3 with a portion of the bonding kit of FIG. 1 installed.
Figure 5:
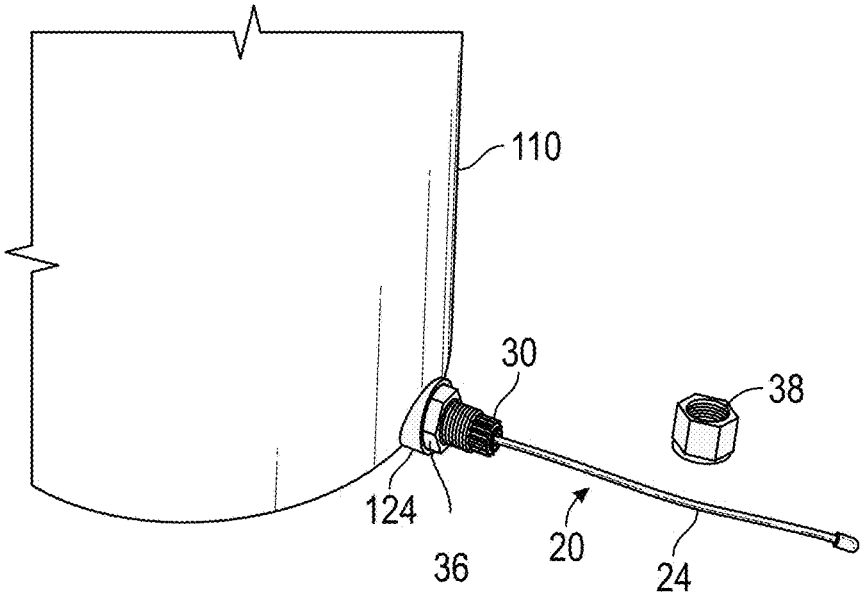
FIG. 5 is a perspective view of a portion of the pump trap illustrated in FIG. 4 with an additional portion of the bonding kit of FIG. 1 installed.
Figure 6:
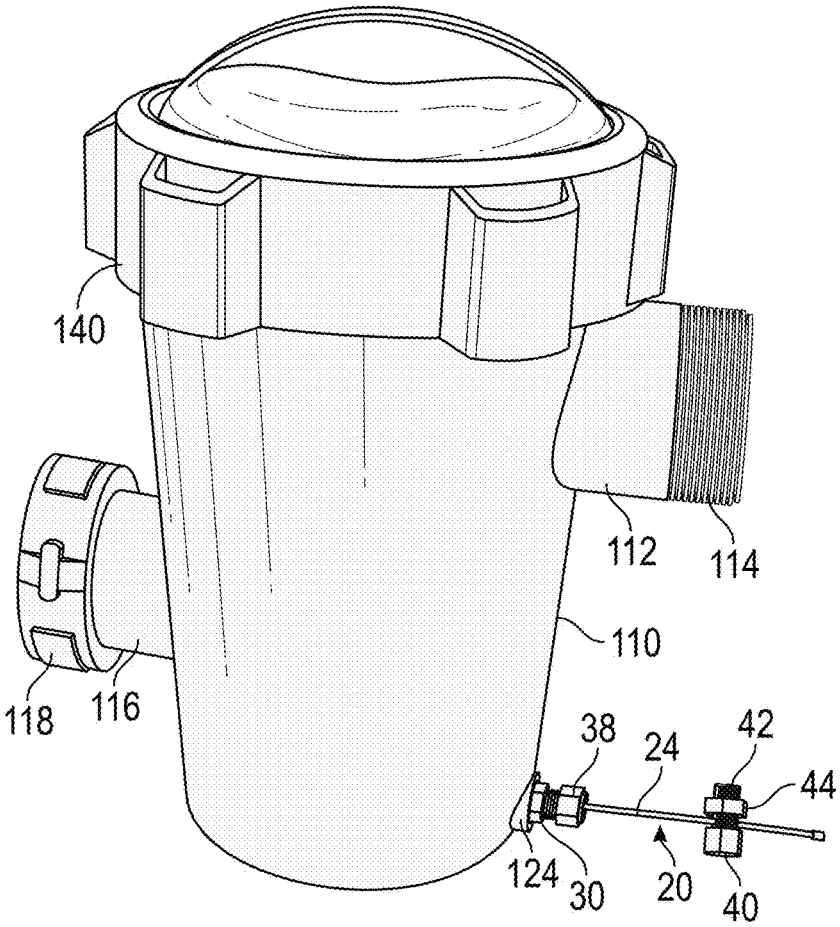
FIG. 6 is a side view of an exemplary pump trap of FIG. 3 with the exemplary bonding kit of FIG. 1 installed.

FIGS. 4-6 show various illustrative aspects of use of the exemplary bonding kit 10 of FIG. 1 with the exemplary pump trap 100 of FIG. 1. In FIG. 4 a perspective view of the exemplary pump trap housing 110 of FIG. 3 with a portion of the retrofit kit of FIG. 1 installed is illustrated. As shown in FIG. 4, the bonding conductor 20 has been placed inside of the housing 110, such that the body portion 22 of the bonding conductor 20 is resting on the bottom inside surface of the housing 110. The extension portion 24 of the bonding conductor 20 has been inserted into the drain hole 124 from the inside of the housing 110, such that the extension portion 24 of the bonding conductor 20 extends outside of the housing 110 through the drain hole 124. The body portion 22 of the bonding conductor 20 has been dimensioned so that it fits within the inner dimension of the housing 110 and rests on the closed bottom of the housing 110. For a differently shaped or configured pump trap 100 or housing 110 than that illustrated in FIG. 3, the bonding conductor 20 of FIG. 1 may also be correspondingly of a different shape and/or configuration.

FIG. 5 is a perspective view of a portion of the housing 110 illustrated in FIG. 4, with an additional portion of the bonding kit 10 of FIG. 1 installed. As illustrated in FIG. 5, the cap 38 of the strain relief fitting 30 has been removed from the strain relief fitting 30. The strain relief fitting 30 has also been placed on the extension portion 24 of the bonding conductor 20, by inserting the extension portion 24 of the bonding conductor 20 through the hollow body of the strain relief fitting 30.

FIG. 5 also illustrates that the strain relief fitting 30 has been inserted into the drain hole 124 of the housing 110. In the embodiment illustrated in FIG. 5, the strain relief fitting 30 is dimensioned such that the outer surface of the strain relief fitting 30 engages with the inner surface of the drain hole 124. Additionally, in the embodiment illustrated in FIG. 5, the threaded outer surface 34 of the strain relief fitting 30 (see FIGS. 1-2) engages with threads on the inner surface of the drain hole 124 in order to secure the strain relief fitting 30 into place. The connector nut 36 of the illustrated strain relief fitting 30 is formed onto the outer surface of the strain relief fitting 30 and is dimensioned so as to be larger in diameter than the opening of the drain hole 124. In this manner, the connector nut 36 may be engaged to tighten the threads of the strain relief fitting 30 with the drain hole 124, and also to ensure that water does not leak out of the drain hole 124 while the strain relief fitting 30 is engaged in the drain hole 124.

In other embodiments, a gasket or O-ring (not shown) may be inserted between the drain hole 124 and the connector nut 36 in order to assist with providing a watertight seal when the strain relief fitting 30 is engaged in the drain hole 124. Similarly, in other embodiments the connector nut 36 may not be integrally formed on the strain relief fitting 30. In such embodiments, the connector nut 36 may be a separate component that engages the outer surface of the strain relief fitting 30 and/or engages a surface of the drain hole 124 in order to assist with securing the strain relief fitting 30 into the drain hole 124.

FIG. 6 is a side view of the exemplary pump trap 100 of FIG. 3 with the exemplary bonding kit 10 of FIG. 1 installed. As illustrated in FIG. 6, the cap 38 has been attached to the strain relief fitting 30 by inserting the extension portion 24 of the bonding conductor 20 through the cap 38 and screwing the cap 38 onto a threaded portion 34 on the outer surface of the strain relief fitting 30. Additionally, the split bolt connector 40 has been attached to the extension portion 24 of the bonding conductor 20 by inserting the extension portion 24 of the bonding conductor 20 into the split in the split bolt connector 40. The nut portion 44 has been engaged with the threaded outer surface 42 of the split bolt connector 40 to hold the connector 40 into place on the extension portion 24. Additionally, the strainer basket 130 has been inserted into the housing 110 and the lid 140 has been affixed to cover the opening in the top of the housing 110, and to hold the strainer basket 130 in place.

With the bonding kit 10 installed in the pump trap 100, the pump trap 100 can be re-installed inline between the pump and the pool using the pump connector port 116 and pipe connector port 112, respectively. A wire or line from the pool grounding or bonding system may then be attached to the split bolt connector 40 (or in some embodiments directly to the extension portion 24 of the bonding conductor 20). In this manner, the bonding kit 10 allows the pump trap to be adapted such that the water inside can be bonded in accordance with the applicable electrical codes (including the NEC) without the need for purchasing a new pump and/or pump trap.

Figure 7:
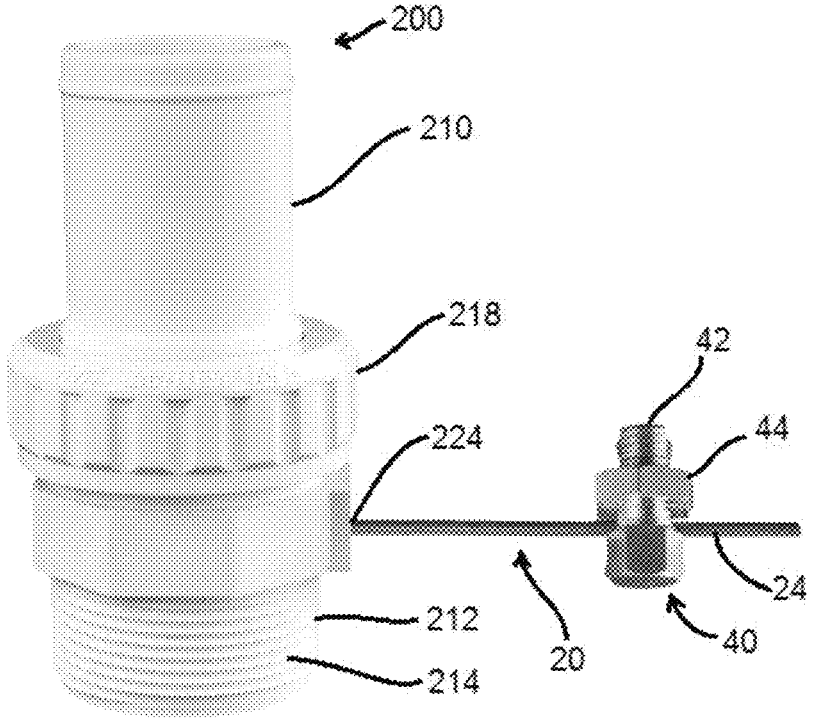
FIG. 7 is a side view of an exemplary bonding kit for use with an adapter fitting.

FIG. 7 is a side view of an exemplary bonding kit 10 in use with an adapter fitting 200. FIG. 7 generally illustrates an adapter fitting 200 with a water bond, and more specifically a hose adapter that threads on one end into a fitting whereby a hose can be attached to the other end of the fitting. Such an embodiment can be a new part, a replacement part, or a retrofit kit, in the water circulation system of a water feature. In this regard, the invention as shown in FIG. 7 is analogous to the invention shown in FIG. 4, wherein the bonding kit 10 is fitted within an adapter fitting 200 rather than within the pump trap 100 housing 110.

The exemplary adapter fitting 200 includes a tubular hose connector portion 210 that preferably is generally cylindrical in shape and hollow, a pipe connector portion 212 that also preferably is generally cylindrical in shape and hollow, and a connector fitting 218 for connecting the hose connector portion 210 to the pipe connector portion 212. The hose connector portion 210 can have a friction fit with the pipe connector portion 212 whereby the hose connector portion 210 fits within the pipe connector portion 212. A gasket or O-ring 250 may be placed between an outwardly extending flange 252 of the hose connector portion 210 and a rim 254 of the pipe connector portion 212 so as create a water-tight or more water-tight seal between the hose connector portion 210 and the pipe connector portion 212. The connector fitting 218 cooperates with the flange 252 of the hose connector portion 210 and a threaded surface 214 of the pipe connector portion 212 so as to attach the hose connector portion 210 to the pipe connector portion 212 in a known manner. The pipe connector portion 212 can be configured to couple to a pipe carrying water within a water circulation system of a pool or other water feature.

Figure 8:
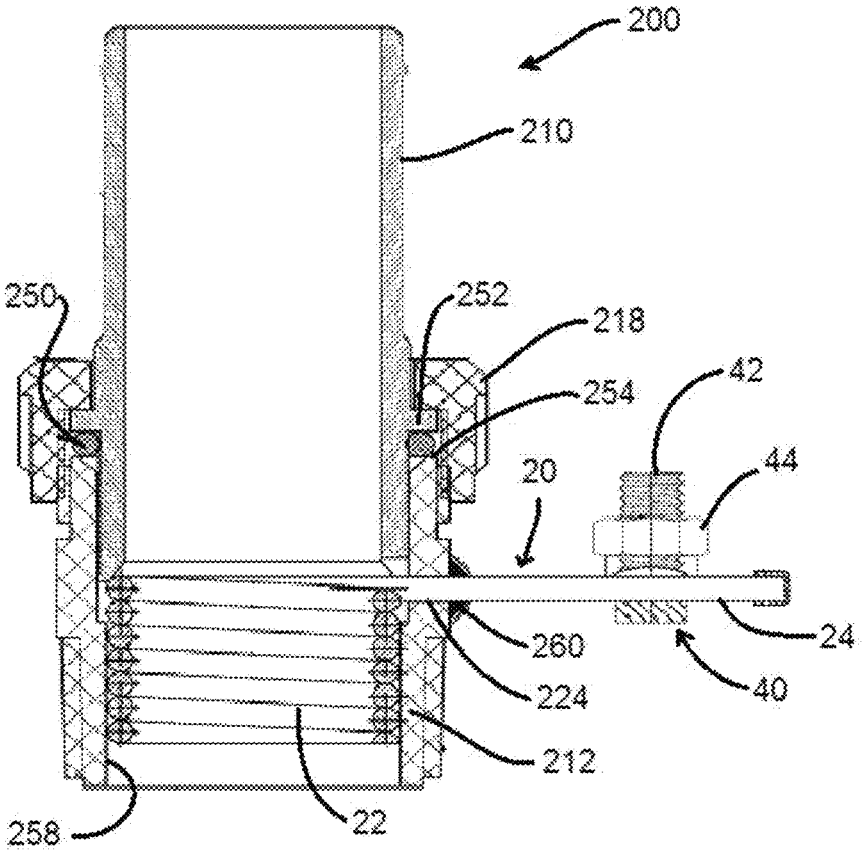
FIG. 8 is a sectional side view of the exemplary bonding kit illustrated in FIG. 7 taken along line 8'-8'.

FIGS. 7-8 show illustrative aspects of use of the exemplary bonding kit 10 of FIG. 1 with the exemplary adapter fitting 200 of FIG. 7. In FIG. 7 a side view of the exemplary adapter fitting 200 with the bonding kit 10 of FIG. 1 installed is illustrated. As shown in FIG. 7, the body portion 22 of the bonding conductor 20 has been placed inside of the pipe connector portion 212, such that the body portion 22 of the bonding conductor 20 is placed in a spiral manner about the inner tubular surface 258 of the pipe connector portion 212. The extension portion 24 of the bonding conductor 20 has been inserted through an access hole 224 from the inside of the pipe connector portion 212, such that the extension portion 24 of the bonding conductor 20 extends outside of the pipe connector portion 212 through the access hole 224. The body portion 22 of the bonding conductor 20 has been dimensioned so that it fits within the inner dimension, namely the inner diameter, of the pipe connector portion 212. For a differently shaped or configured pipe connector portion 212 than that illustrated in FIG. 7, the bonding conductor 20 of FIG. 1 may also be correspondingly of a different shape and/or configuration.

The embodiment shown in FIGS. 7-8 does not include a strain relief fitting 30, but instead comprises a slide fit or friction fit between the extension portion 24 and the inner surface of the access hole 224. A gasket or O-ring 260 may be included about the extension portion 24, either outside of the access hole 224 as better shown in FIG. 8 or within the access hole 224 (not shown), in order to assist with providing a watertight seal when the extension portion 24 extends through the access hole 224.

FIG. 8 is a sectional side view of the exemplary bonding kit 10 installed in the exemplary adapter fitting 200 illustrated in FIG. 7 taken along line 8'-8'. In this view, the bonding conductor 20 can be seen within the interior of the pipe connector portion 212, such that the body portion 22 of the bonding conductor 20 is placed in a spiral or coil manner about the inner tubular surface 258 of the pipe connector portion 212. The bonding conductor 20 is shown in the lower half or portion of the pipe conductor portion 212 where it will not interfere with the insertion and placement of the hose connector portion 210 within the pipe connector portion 212. The extension portion 24 of the bonding conductor 20 extends outwardly from the interior of the pipe connector portion 212 through the access hole 224 such that the extension portion 24 of the bonding conductor 20 extends outside of the pipe connector portion 212 through the access hole 224. As discussed previously, the body portion 22 of the bonding conductor 20 has been dimensioned so that it fits within the inner dimension, namely the inner diameter, of the pipe connector portion 212. For a differently shaped or configured pipe connector portion 212 than that illustrated in FIGS. 7-8, the bonding conductor 20 of FIG. 1 may also be correspondingly of a different shape and/or configuration.

As illustrated in FIG. 8, the inner diameter of the access hole 224 preferably is substantially similar or slightly greater than the diameter of the extension portion 24 of the bonding conductor 20. This allows the extension portion 24 to slide through and/or friction fit with the access hole 224. Within on adjacent to the access hole 224, a gasket or O-ring 260 may be included to cooperate with the extension portion 24, either outside of the access hole 224 as shown in FIG. 8, in the interior of the pipe connector portion 212 (not shown), or within the access hole 224 (not shown), in order to assist with providing a watertight seal when the extension portion 224 extends through the access hole 224.

In a manner similar to the embodiments shown in FIGS. 1-6, a split bolt connector 40 has been attached to the extension portion 24 of the bonding conductor 20 by inserting the extension portion 24 of the bonding conductor 20 into the split in the split bolt connector 40. The nut portion 44 has been engaged with the threaded outer surface 42 of the split bolt connector 40 to hold the connector 40 into place on the extension portion 24.

FIGS. 9-13 illustrate another exemplary embodiment of the invention in the form of a new part or a replacement part, such as a skimmer housing 300 for holding a skimmer basket 330 typically at the side of a water feature. Skimmer baskets 330 and skimmer housings 300 are known in the art and often comprise a housing 300 secured within the wall structure or at the edge of a pool, and a skimmer basket 330 removably fitted within the housing 300 for catching debris from the pool and preventing the debris from entering the water circulation system of the pool. The bonding kit 10 can be fitted within the skimmer housing 300.

Figure 9:
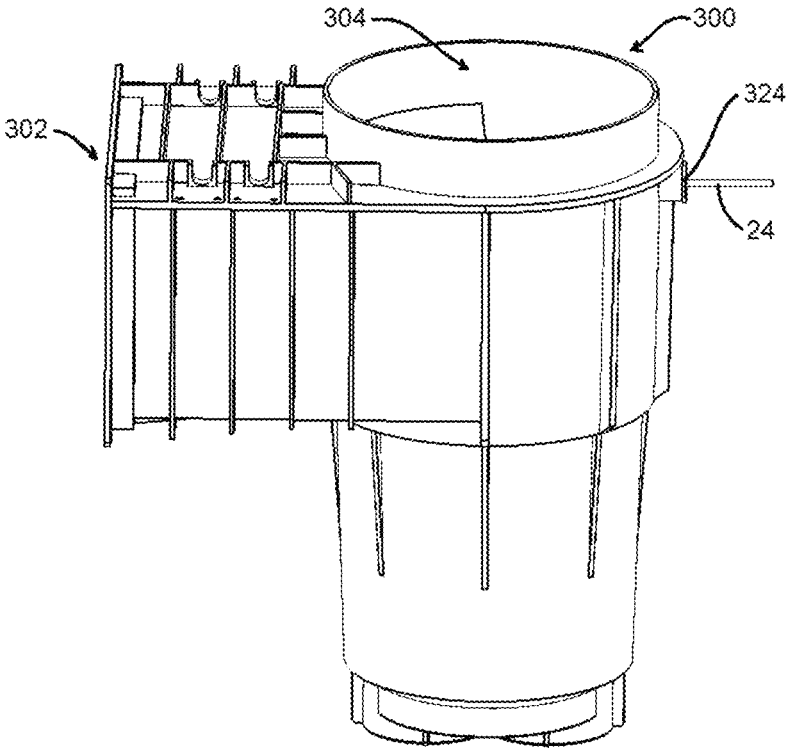
FIG. 9 is a side perspective view of an exemplary bonding kit for use with a housing into which a pool skimmer can be placed.
Figure 10:
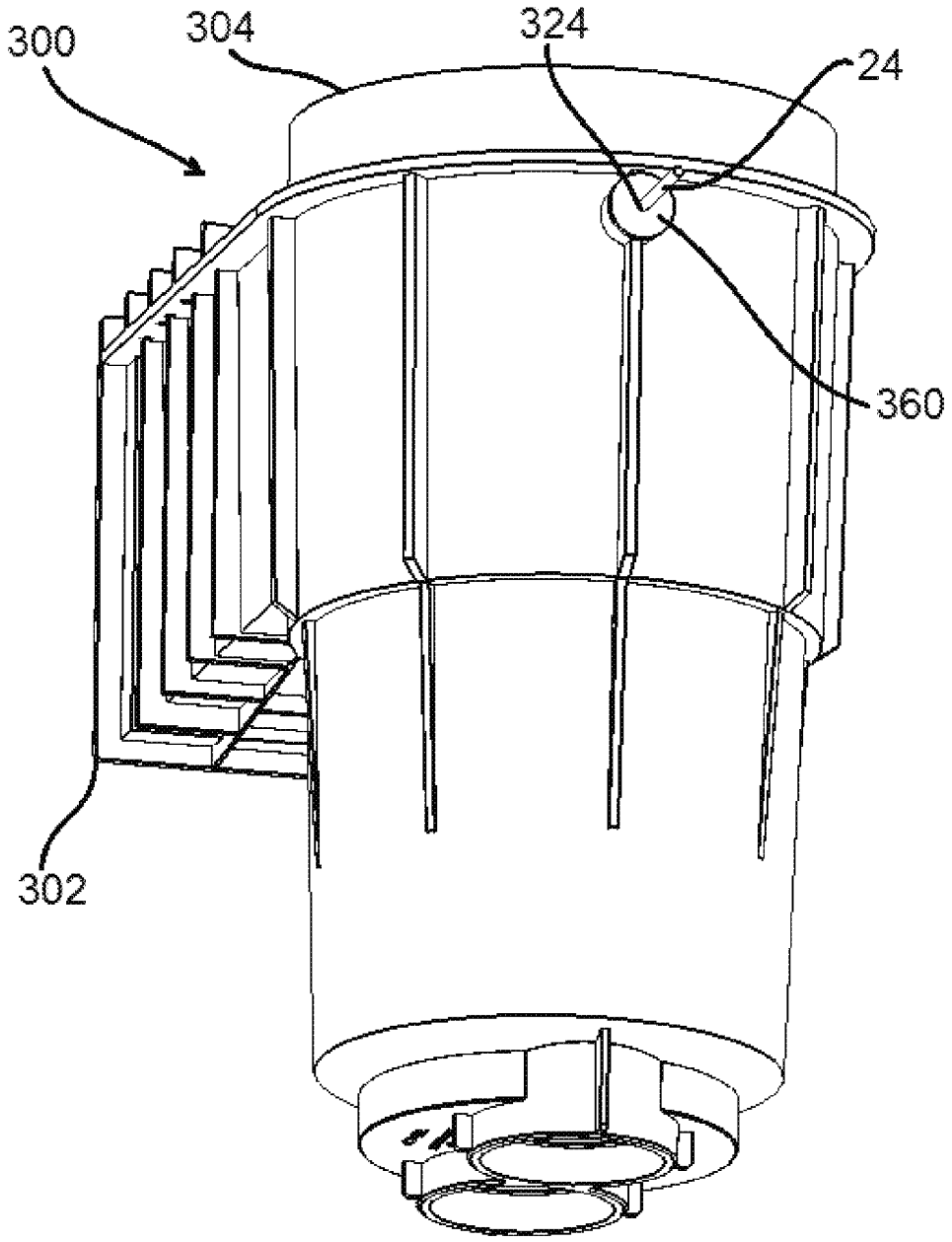
FIG. 10 is a rear view of the exemplary bonding kit illustrated in FIG. 9.

FIG. 9 is a side perspective view, and FIG. 10 is a rear view, of an exemplary bonding kit 10 in use with a tube or housing 300 into which a pool skimmer basket 330 can be placed. The housing 300 has a rectangular opening 302 is attached to a flared piece 370 and other attachment and mounting components 372, 374, 376, 378, 380 (see FIG. 13) that attach to the housing 300 and/or to the skimmer opening into the pool or other water feature. The housing 300 also has a round opening 304 through which the skimmer basket 330 can be inserted or removed. The bonding conductor 20 enters the housing 300 through an access hole 324 on the rear of the housing, typically opposite the rectangular opening 302 and below the round opening 304. As shown in more detail in FIG. 11, the bonding conductor 20 of this embodiment is attached to the inside wall of the housing 300 and travels vertically downward form the access hole 324. As there generally is a clearance between the skimmer basket 330 and the inner side wall of the housing 300, the skimmer basket 330 can then be placed within the housing 300 without interference from the bonding conductor 20.

Figure 11:
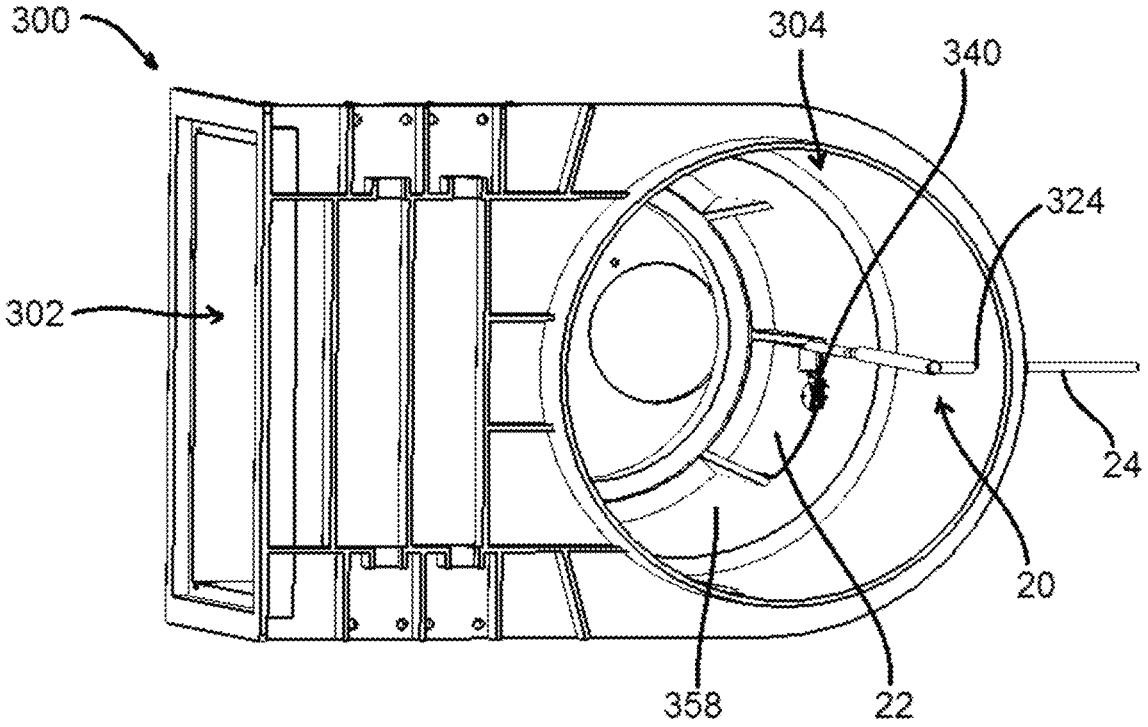
FIG. 11 is a top view of the exemplary bonding kit illustrated in FIG. 9.
Figure 12:
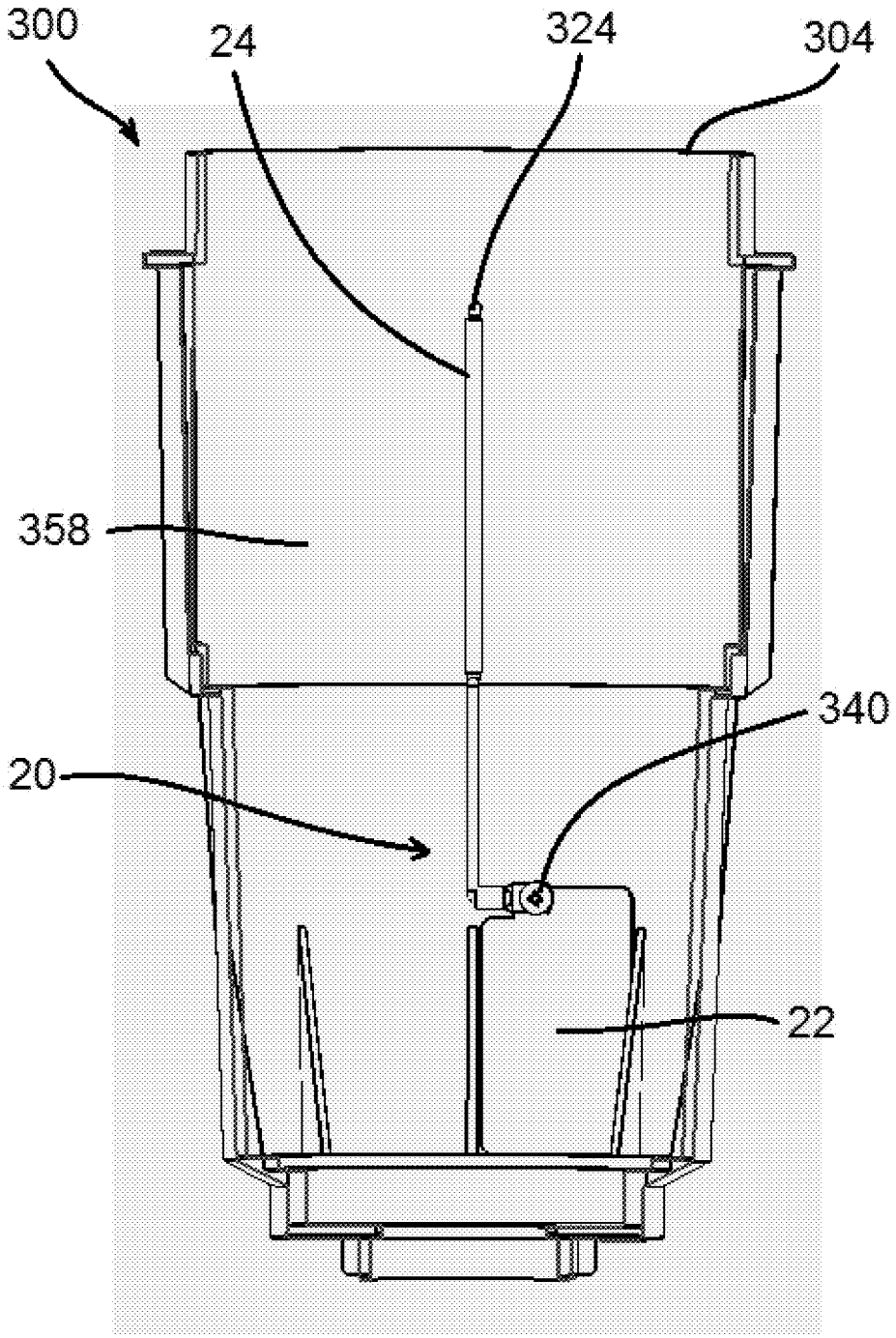
FIG. 12 is a front sectional view of the exemplary bonding kit illustrated in FIG. 9 taken along line 12'-12'.

FIG. 11 is a top view, and FIG. 12 is a front sectional view, of the exemplary tube or housing 300 illustrated in FIG. 9 taken along line 12'-12'. In FIGS. 11 and 12, the placement of the bonding conductor 20, and more specifically the placement of an exemplary embodiment of the body portion 22 of the bonding conductor 20, can be seen in more detail. As previously mentioned, the extension portion 24 of the bonding conductor 20 enters the housing 300 through the access hole 324 and extends downwards along the inside surface of the housing 300. The extension portion 24 of the bonding conductor 20 then is connected to the body portion 22 of the bonding conductor 20. In the embodiment shown in FIGS. 11 and 12, the body portion 22 is not a coil as shown in the embodiments of FIGS. 2-8, but instead is a flat plate. The flat plate body portion 22 is shaped so as to match or nearly match the inner contour of the inner surface 358 of the wall of the housing 300 so that the flat plate body portion 22 also will not interfere with the insertion or removal of the skimmer basket 330 from the housing 300.

The body portion 22 of the bonding conductor 20 has been dimensioned in this embodiment so that it fits within the inner dimension, namely the inner diameter, of the housing 300. For a differently shaped or configured housing 300 than that illustrated in FIG. 11, the bonding conductor 20 of FIG. 1 may also be correspondingly of a different shape and/or configuration. For example, the body portion 22 can be a spiral or coil, such as shown in the embodiments of FIGS. 2-7, if the housing 300 is of a sufficient size and shape to accommodate such a structure without interfering with the insertion and removal of the skimmer basket 330. Similarly, other shapes can be used for the body portion 24 so long as the body portion 24 has sufficient surface area to properly serve in a bonding capacity.

The connection between the extension portion 24 and the body portion 22 shown in FIGS. 11 and 12 is a simple screw connection 340. This allows for easier installation, removal, and replacement of both the extension portion 24 and the body portion 22 from the housing 300. Alternatively other connection types can be used, such as but not limited to soldering, adhesives, clips, and friction fits.

Figure 13:
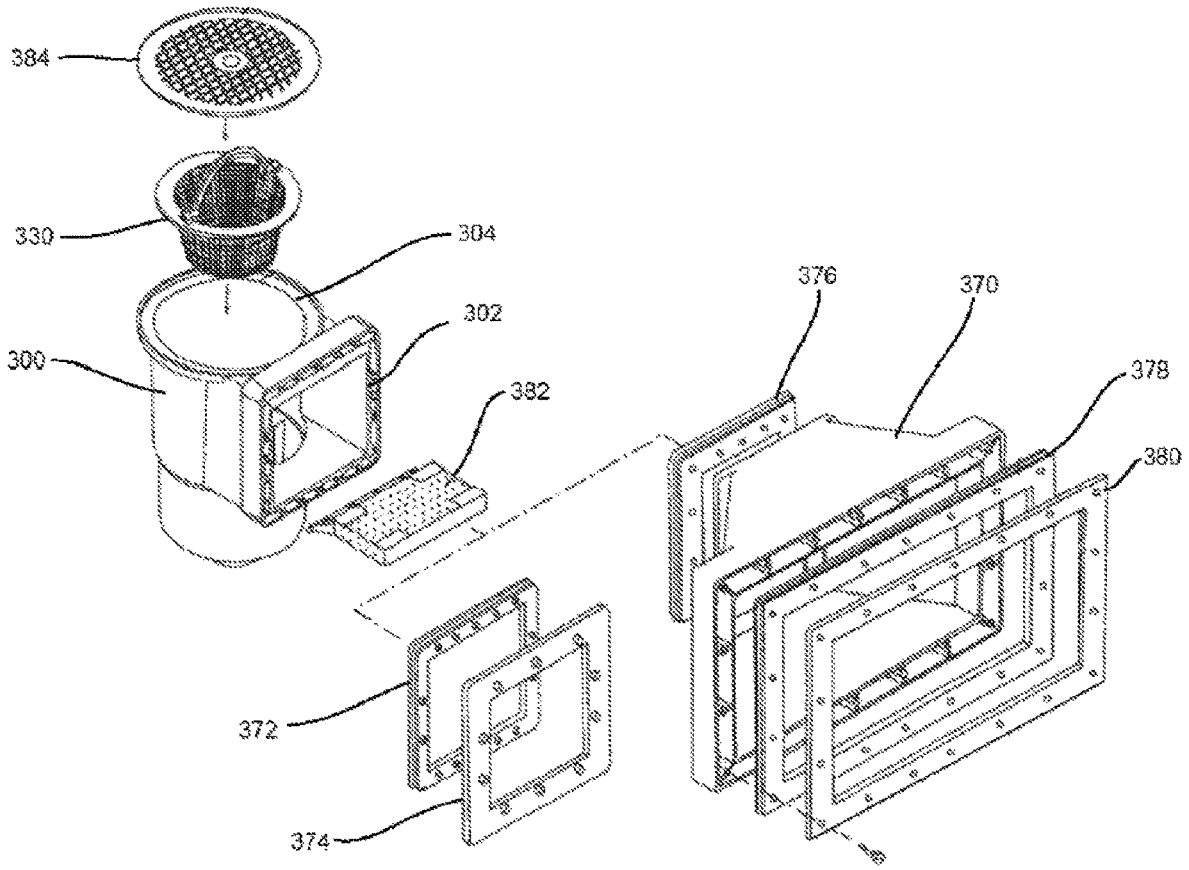
FIG. 13 is an exploded perspective view of the skimmer and housing with which the exemplary bonding kit of FIG. 9 can be used.

FIG. 13 is an exploded perspective view of the skimmer basket 330 and housing 300 with which the exemplary bonding kit 10 of FIG. 9 can be used. The structure of the pool component can be seen in more detail, and includes a typical swing door 382 for closing rectangular opening 302 and a typical lid 384 for closing round opening.

The embodiment shown in FIGS. 9-13 also does not include a strain relief fitting 30, but instead comprises a slide fit or friction fit between the extension portion 24 and the inner surface of the access hole 324. A gasket or O-ring 360 may be included about the extension portion 24, either outside of the access hole 324 as better shown in FIG. 10 or within the access hole 324 (not shown), in order to assist with providing a watertight seal when the extension portion 24 extends through the access hole 324.

Although selected aspects of the exemplary bonding kit 10 and exemplary housings 100, 200, 300 have been illustrated and described, it will be understood that various substitutions and alterations may be made to the bonding kit 10 and/or the housings 100, 200, 300 without departing from the spirit and scope of the present invention. For example, it is anticipated that the bonding kit 10 and/or the components thereof may be sized and/or dimensioned to work with any size, shape, or dimension of housing 100, 200, 300, or with any other component in which equipotential bonding is desired, such as, but not limited to, skimmers, plumbing fixtures, pump traps, valves, drains, etc. Similarly, although the body portion 22 of the bonding conductor 20 is illustrated as a round coil and a flat plate, it is envisioned that the body portion 22 may be any shape or size desired. For instance, the bonding conductor 20 may be a straight length of flexible conducting material that can be shaped at installation into any shape, dimension or configuration desired to work with the housing 100, 200, 300 or other component with which the bonding kit 10 intended to be used.

The above detailed description of the embodiments, and the examples, are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

LIST OF REFERENCE NUMERALS

10 retrofit kit, invention, device
20 bonding conductor
22 body portion of bonding conductor
24 extension portion of bonding conductor
30 strain relief fitting
32 top opening of strain relief fitting
34 threaded portion of strain relief fitting
36 connector nut of strain relief fitting
38 hollow cap of strain relief fitting
40 split bolt connector
42 body portion of split bolt connector
44 nut portion of split bolt connector
100 pump trap
110 housing of pump trap
112 pipe connector port
114 threaded portion of housing of pump trap
116 pump connector port
118 connector fitting of housing of pump trap
120 top opening of pump trap
122 threaded surface of housing of pump trap
124 access or drain hole
130 strainer basket
132 inlet opening of strainer basket
140 lid
200 adapter fitting
210 hose connector portion
212 pipe connector portion
214 threaded surface
218 connector fitting
224 access hole
250 gasket or o-ring
252 flange
254 rim
258 inner tubular surface
260 gasket or o-ring
300 skimmer housing
302 rectangular opening
304 round opening
324 access hole
330 skimmer basket
340 screw connection
358 inner surface
360 gasket or o-ring
370 flared piece
372 mounting component
374 mounting component
376 mounting component
378 mounting component
380 mounting component
382 swing door
384 lid

What is claimed is:

1. A retrofit bonding kit for use in combination with a pre-existing housing component of a water-holding structure, the housing component in fluid communication with a water flow in the water-holding structure, the water flow entering the housing component as an inlet water flow through a water inlet, the water flow exiting the housing component as an outlet water flow through ports through a bottom surface of the housing component, the ports allowing the water flow to exit the housing component in a direction perpendicular to the inlet water flow, the housing component defining an opening opposite the bottom surface, the housing component comprising an inside surface, an outside surface, and an access hole traversing the inside surface to the outside surface of the housing component, the access hole located in a position opposite the water inlet of the housing component and below the opening to the housing component, the retrofit bonding kit comprising:

a) a bonding conductor comprising:

i) a body portion shaped from a length of flexible material wherein the body portion is contoured along the inside surface of the housing component in a position parallel to the outlet water flow, with at least nine square inches of total conductive surface area, and wherein the length of the body portion defines a conductive surface, the body portion configured to reside within the housing component in constant contact with the water flow therein; and ii) an extension portion shaped from another length of flexible material wherein the extension portion is attached to the body portion and contoured along the inside surface of the housing component, the extension portion configured to extend outwardly from within the housing component, through the access hole of the housing component; and b) a conductor fitting configured to attach to the extension portion that extends outside of the housing component, and configured to attach to a conductive system for the water-holding structure, providing an electrical connection between the bonding conductor and the conductive system;

wherein the bonding conductor provides equipotential bonding for the water flow therein;

wherein no portion of the extension portion extends outwardly from within the housing component through the ports through the bottom surface of the housing component so as to reduce potential water leakage from the housing component; and wherein the bonding conductor is attached to the inside surface of the housing component in a position traveling vertically downward from the access opening of the housing component.

2. The retrofit bonding kit of claim 1, wherein the inside surface and the outside surface of the housing component define a cylindrical housing therebetween, and wherein the body portion is contoured, parallel to the outlet water flow, along the inside surface of the cylindrical housing component.

3. The retrofit bonding kit of claim 1, wherein the access hole traversing the inside surface to the outside surface of the housing component is perpendicular to the outlet water flow.

4. The retrofit bonding kit of claim 2, wherein the access hole traversing the inside surface to the outside surface of the housing component is perpendicular to the outlet water flow.

5. The retrofit bonding kit of claim 1, wherein the extension portion is a single unitary wire contoured along the inside surface.

6. A water-holding structure bonding kit comprising:

a) a housing component comprising a water inlet, a bottom surface, a water outlet port through the bottom surface, an opening opposite the bottom surface, an inside surface, an outside surface, and an access hole traversing the inside surface to the outside surface, the access hole located in a position opposite the water inlet and below the opening;

b) the housing component being in fluid communication with a water flow in a water-holding structure, the water flow entering the housing component as an inlet water flow through the water inlet, the water flow exiting the housing component as an outlet water flow through the outlet port, the outlet port allowing the water flow to exit the housing component in a direction perpendicular to the inlet water flow;

c) a bonding conductor comprising:

i) a body portion shaped from a length of flexible material wherein the body portion is contoured along the inside surface of the housing component in a position parallel to the outlet water flow, with at least nine square inches of total conductive surface area, and wherein the length of the body portion defines a conductive surface, the body portion configured to reside within the housing component in constant contact with the water flow therein; and ii) an extension portion shaped from another length of flexible material wherein the extension portion is attached to the body portion and contoured along the inside surface of the housing component, the extension portion configured to extend outwardly from within the housing component through the access hole of the housing component; and d) a conductor fitting configured to attach to the extension portion that extends outside of the housing component, and configured to attach to a conductive system for the water-holding structure, providing an electrical connection between the bonding conductor and the conductive system;

wherein the bonding conductor provides equipotential bonding for the water flow therein;

wherein no portion of the extension portion extends outwardly from within the housing component through the outlet port so as to reduce potential water leakage from the housing component; and wherein the bonding conductor is attached to the inside surface of the housing component in a position traveling vertically downward from the access opening of the housing component.

7. The water-holding structure bonding kit of claim 6, wherein the inside surface and the outside surface of the housing component define a cylindrical housing therebetween, and wherein the body portion is contoured, parallel to the outlet water flow, along the inside surface of the cylindrical housing component.

8. The water-holding structure bonding kit of claim 7, wherein the access hole traversing the inside surface to the outside surface of the housing component is perpendicular to the outlet water flow.

9. The water-holding structure bonding kit of claim 6, wherein the access hole traversing the inside surface to the outside surface of the housing component is perpendicular to the outlet water flow.

10. The water-holding structure bonding kit of claim 6, wherein the extension portion is a single unitary wire contoured along the inside surface of the housing component.

* * * * *